US006289705B1

(12) United States Patent
Duquenne et al.

(10) Patent No.: US 6,289,705 B1
(45) Date of Patent: Sep. 18, 2001

(54) METHOD FOR THE ULTRASONIC PEENING OF LARGE SIZED ANNULAR SURFACES OF THIN PARTS

(75) Inventors: Catherine Dominique Béatrice Duquenne, Hericy; Véronique Christiane Raymonde Giffard, Saint Vrain; Gérard Michel Roland Gueldry, Vert Saint Denis; Claude Marcel Mons, Savigny le Temple, all of (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/714,223

(22) Filed: Nov. 17, 2000

(30) Foreign Application Priority Data

Nov. 18, 1999 (FR) ..... 99 14481

(51) Int. Cl.[7] ..... C21D 7/06
(52) U.S. Cl. ..... 72/53; 29/90.7
(58) Field of Search ..... 72/53; 29/90.7

(56) References Cited

U.S. PATENT DOCUMENTS 5,509,286 4/1996 Coulon .
5,829,116 * 11/1998 Vilon ..... 72/53

FOREIGN PATENT DOCUMENTS 0 492 323 7/1992 (EP) .
2 689 431 10/1993 (FR) .
1435627 * 11/1988 (SU) ..... 72/53

OTHER PUBLICATIONS

Derwent Abstracts, Accession Number 89–143538/19, SU 1435627, Nov. 7, 1988.

Derwent Abstracts, Accession Number 2000–315575/27, RU 2130085, May 10, 1999.

* cited by examiner

*Primary Examiner*—David Jones
(74) *Attorney, Agent, or Firm*—Oblon, Spivak, McClelland, Maier & Neustadt, P.C.

(57) ABSTRACT

A method of so-called "ultrasonic" peening is described for peening large sized annular surfaces on thin parts. The method uses a microbead mist vibrated in a chamber with an opening so that the surface that is to be peened makes at least five movements past the opening of the peening chamber during peening so as to reduce deformation of the part.

2 Claims, 1 Drawing Sheet

METHOD FOR THE ULTRASONIC PEENING OF LARGE SIZED ANNULAR SURFACES OF THIN PARTS

BACKGROUND OF THE INVENTION

1. Field of the Invention

The invention relates to a method of so-called "ultrasonic" peening using a mist of microbeads inside a chamber and more particularly to a method for peening large sized annular surfaces on thin parts.

2. Summary of the Prior Art

It is known practice for the surfaces of metal parts to be peened by blasting with microbeads. By impacting the surface of the metal part with a small angle of incidence with respect of the perpendicular to this surface and with sufficient kinetic energy, the microbeads cause permanent compression of the surface to a small depth. This compression inhibits the initiation and propagation of cracks at the surface of the metals part and thus improves the fatigue strength of that metal part.

The microbeads are commonly ball bearings. They are usually made of ceramic or steel with a diameter in the range 0.2 mm to 4 mm. Peening is performed inside a closed booth using nozzles supplied both with compressed gas and with microbeads, the compressed gas propelling the microbeads towards the metal part.

In the aeronautical industry, thin metal parts of large dimension are manufactured. A number of difficulties are encountered in peening these thin metal parts. For example, large metal parts require large closed booths for peening operations.

Peening is often light in order not to deform the thin metal parts. This is because thin metal parts are unable, without deforming, to absorb the loadings caused by the compressive stresses resulting from the microbeads of heavy peening.

There is an optimum exposure of the metal part to peening for imparting the best strength. However, such optimum exposure to peening is difficult to achieve because peening nozzles are difficult to adjust and are not stable. Insufficient peening does not give the anticipated strength, but additional peening to achieve the optimum exposive may lead to excessive peening which causes irreparable surface damage to the metal part, with a resultant reduction in the strength of that metal part.

French Patent 2 689 431 discloses a modified method of ultrasonic peening which involves sustaining a "mist" or microbeads inside a chamber. The mist of microbeads is sustained by a vibrator operating at frequencies in the order of 20 kHz. The chamber is open and the metal is pressed against the opening of the chamber. Peening is by microbead impact on the metal part. The chamber and the metal parts are given a relative movement aimed at causing the chamber to pass over the entire surface of the metal part to be peened. The patent also discloses how to peen circular parts such as shafts.

The term "mist" is used by analogy with the mists formed by minuscule water droplets. In ultrasonic peening, the microbeads have speeds which are random both in magnitude and in direction, which causes the microbeads to ricochet off each other, off the walls of the chamber and off the surface of the part in contact with the mist of microbeads.

FR2689431 provides examples of massive parts capable of absorbing, without deformation, the loadings resulting from peening in accordance with its method. However, the method of FR 2689431 does not allow the peening of thin circular metal parts, as these circular metal parts begin to deform very early in the peening operation. Even if the surface of the thin circular part is peened uniformly, these deformations are only partially absorbed at the end of the peening operation as they are plastic and non-linear deformations of the material. In addition, the method of FR 2689431 demands, if uniform peening is to be obtained, that peening be halted precisely when the circular metal part has made one revolution. Otherwise, over rotation would produce a localized excess of peening on a zone of overlap, whereas under rotation would give rise to a gap of localized lack of peening which would be difficult to correct without giving rise to excessive peening in a region immediately adjacent the original gap of lack of peening.

A first problem, therefore, is that of peening thin and circular parts whose dimensions exceed those of the peening chamber, without deforming the parts. A second problem is that of guaranteeing uniform peening across the entire surface that is to be peened.

SUMMARY OF THE INVENTION

The present invention provides a method for ultrasonic peening a large sized annular surface of a thin part, said method comprising the steps of:

a) providing a chamber with an opening and a vibrator within said chamber;

b) providing a plurality of microbeads in said chamber;

c) causing relative rotational movement of said thin part and said chamber whereby said annular surface to be peened moves relatively past said opening;

d) operating said vibrator to sustain said plurality of said microbeads as a mist of microbeads in said chamber such that microbeads impact on the annular surface to be peened as the surface moves relatively past said opening; and e) containing said relative rotational movement such that said annular surface makes at least five rotations past the said opening.

In other words, peening is performed in N passes past the opening of the chamber, each point of the surface that is to be peened passing N times past the opening of the chamber, each passage performing a fraction roughly equal to 1/N of the total peening that is to be performed.

A method such as this has the effect of improving the uniformity of the peening over the entire surface that is to be peened. It has been noted that this uniformity reduces the deformations of the part during peening and the residual deformation of the part when peening is finished. The loadings imposed on the part during peening remain roughly uniform across the entire peened surface. The first problem is thus solved.

In addition, it is no longer necessary to halt the peening precisely when the part has made N passes past the peening chamber. The excess or lack of peening as the result of this imprecision will at most be equal to 1/N of the total peening. This solves the second problem.

N must be at least 5 in order to achieve acceptable results. However, better results are achieved with a greater number of revolutions or passes, for example if N is 20 or 100. A high number N of revolutions or passes is dictated when peening very thin parts.

A particular advantage of the present method is that it allows significant and thorough peening. Thus, more optimal peening on thin parts may be achieved without deformation. It will be understood that, during peening in accordance with present invention, the loadings imposed on the part remain uniform.

The method that is the subject of this patent application must not be confused with the method disclosed in the aforementioned FR2689431. Although FR2689431 does not state explicitly that peening is performed in a single pass, FR 2689431 does infer that such a single pass is required. Specifically, in FR2689431 at Page 7 line 20 gives the formula Vi=Ai/To, Vi being the rate of travel of the chamber over the part, Ai being the width of the vibrating surface which is practically coincident with the width of the chamber in the light of FIG. 1, and To being the time that the surface is exposed to peening, this time being given by a formula at Page 7 line 7. If peening were performed in N passes, FR 2689431 would have had to state Vi=N×Ai/To so that each part of the surface that is to be peened was properly exposed for the duration To. Now, the only way of interpreting FR 2689431 is that N=1.

Furthermore, it is stated particularly at page 7 lines 24–34 that a higher speed leads to insufficient peening whereas a lower speed leads to "excessive work hardening". The speed parameter Vi is important here because the entire periphery of the part has to be peened exactly in one single revolution or in a very small number or revolutions in order to observe the time To for which each surface part is to be exposed to peening. With the present invention on the other hand, this speed parameter is of no importance, provided of course that it remains slow by comparison with the speed of the microbeads impacting the part.

BRIEF DESCRIPTION OF THE DRAWINGS

The invention will be better understood and the advantages it affords will become more clearly apparent from the following description of a preferred embodiment and with reference to the attached drawing. The single FIGURE illustrates the peening of the bearing surface of the flange of an aircraft turbine engine conical rotor support by the method of the invention.

DETAILED DESCRIPTION OF THE INVENTION AND PREFERRED EMBODIMENT

Figure 1:
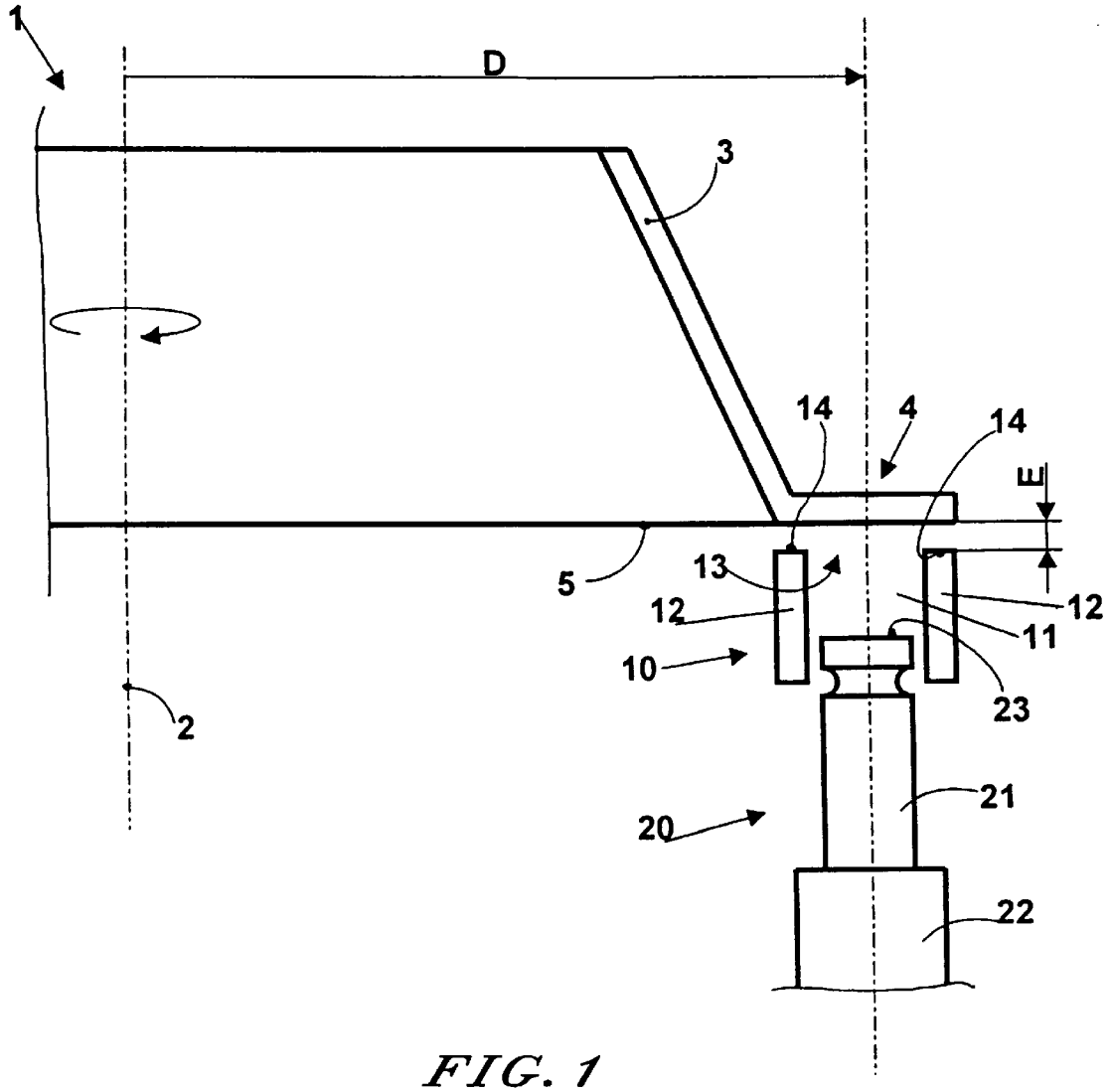

Referring to the drawing, the part 1 is an aircraft turbine engine conical rotor support having a thin wall and with a geometric axis 2 of revolution. The part 1 comprises a frustoconical barrel 3, the larger-diameter end of which is extended radially by a flange 4. The flange 4 itself comprises a bearing surface 5 that is to be peened. The bearing surface 5 is annular, flat and radial.

Use is made of chamber 10 inside which a mist of microbeads 11 is sustained. This chamber is laterally delimited by a wall 12 and comprises an opening 13 the edges of which are referenced 14. Use is also made of a vibrator 20 consisting of a sonotrode 21 brought into resonance via one of its ends by a vibration generator 22 which is usually of the quartz type. The other end of the sonotrode 21 comprises a vibrating and essentially flat surface 23. The vibrating surface 23 is placed at the bottom of the chamber 10 and faces towards the opening 13. The vibration generator 22 sets the sonotrode 21 into longitudinal vibration. The surface 23 is thus vibrated and transmits energy to the microbeads, causing them to rebound off the surface 5 that is to be peened facing the opening 13 and off the walls of the chamber 12. The microbeads gradually loose energy, but on arriving back into contact with the vibrating surface 23 the microbeads are given further energy by the vibrating surface. Thus, the microbeads move around inside the chamber at speeds which are random both in magnitude and in direction, the microbeads thus forming a true "mist" of microbeads inside the chamber 10.

To peen the surface 5:

a dose of microbeads is placed in the chamber, the part 1 is positioned in such a way as to bring the surface 5 that is to be peened over the opening 13 with a clearance E with respect to the edges 14 of the opening 13, said clearance E being less than the diameter of the microbeads, the part 1 is set in rotation about its geometric axis 2.

the vibration generator 23 is activated for a predefined length of time T, said rotational speed of the part 1 being set so that the part makes at least N=five revolutions in the time T, the vibration generator 23 is halted after the time F and the part 1 is removed.

One advantage of the method is that peening is performed without contact between the part 1 and the chamber 10, which makes it possible to avoid any surface damage to the part.

In spite of that, the microbeads are held inside the chamber 10 because the clearance E is smaller than the diameter of said microbeads.

This arrangement also has the advantage of avoiding the use of wearing shoes on the chamber 10.

The total time F for which the part is exposed to the peening is therefore given by the formula:

$$T=To\times\pi\times D/L$$

in which To is the time that each element of the surface is to be peened spends exposed to the peening D is the mean diameter of said surface 5 and L is the width of the chamber 10 measured tangentially to the movement of said surface 5 past the opening 13, that is to say at right angles to the plane of the single FIGURE.

If the surface 5 that is to be peened is not flat, the edges 14 of the chamber 10 will be given a shape that complements said surface, in order to maintain the clearance E.

What is claimed is:

1. A method for ultrasonic peening a large sized annular surface of a thin part, said method comprising the steps of:

a) providing a chamber with an opening and a vibrator within said chamber;

b) providing a plurality of microbeads in said chamber;

c) causing relative rotational movement of said thin part and said chamber whereby said annular surface to be peened moves relatively past said opening;

d) operating said vibrator to sustain said plurality of said microbeads as a mist of microbeads in said chamber such that microbeads impact on the annular surface to be peened as the surface moves relatively past said opening; and e) containing said relative rotational movement such that said annular surface makes at least five rotations past the said opening.

2. Method according to claim 1, wherein the surface that is to be peened is positioned in front of the opening with a clearance smaller than the diameter of the microbeads used.

* * * * *